US011747103B2

(12) United States Patent
Mueller et al.

(10) Patent No.: US 11,747,103 B2
(45) Date of Patent: Sep. 5, 2023

(54) LOADING MECHANISM FOR SUSPENDED LOOP AMMUNITION

(71) Applicant: Moog Inc., Elma, NY (US)

(72) Inventors: Frank R. Mueller, Santa Ynez, CA (US); Brian J. Quinn, Goleta, CA (US)

(73) Assignee: Moog Inc., Elma, NY (US)

( * ) Notice: Subject to any disclaimer, the term of this patent is extended or adjusted under 35 U.S.C. 154(b) by 0 days.

(21) Appl. No.: 17/759,860

(22) PCT Filed: Feb. 25, 2021

(86) PCT No.: PCT/US2021/019563

§ 371 (c)(1),
(2) Date: Aug. 1, 2022

(87) PCT Pub. No.: WO2021/221770

PCT Pub. Date: Nov. 4, 2021

(65) Prior Publication Data

US 2023/0140580 A1 May 4, 2023

Related U.S. Application Data

(60) Provisional application No. 62/985,943, filed on Mar. 6, 2020.

(51) Int. Cl.
*F41A 9/86* (2006.01)
*F41A 9/34* (2006.01)

(52) U.S. Cl.
CPC . *F41A 9/34* (2013.01); *F41A 9/86* (2013.01)

(58) Field of Classification Search
CPC ..... F41A 9/86; F41A 9/34; F41A 9/00; F41A 9/32; F41A 9/33; F41A 9/29; F41A 9/56; F41A 9/57; F41A 9/82
(Continued)

(56) References Cited

U.S. PATENT DOCUMENTS 2,180,741 A * 11/1939 Lisov ..... F41A 9/78 42/6
2,386,894 A * 10/1945 Hartley ..... F41A 9/86 89/33.16

(Continued)

FOREIGN PATENT DOCUMENTS

CA 2070510 A1 1/1993
FR 3017202 A1 * 8/2015 ..... F41A 9/34

(Continued)

*Primary Examiner* — John Cooper

(74) *Attorney, Agent, or Firm* — Hodgson Russ LLP

(57) ABSTRACT

A mechanism for loading suspended loops of linked ammunition onto rails of an ammunition magazine includes a guideway and a carriage. The guideway has cam surfaces and cam slots each extending vertically from a lower portion of the guideway and curving near an upper portion of the guideway toward the rails at a loading end of the magazine. The carriage includes a support block slidably received by the guideway and a tandem bucket mounted on the support block by a linkage. The tandem bucket includes inner and outer followers engaging the cam surfaces and cam slots. The tandem bucket is horizontal and may be loaded with two adjacent rounds of a belt of linked ammunition when the carriage is at a lowered position. The carriage may then be raised manually, wherein the tandem bucket is articulated by camming engagement of the followers to a vertical orientation to deposit one of the two rounds onto the magazine rails with the other round and trailing rounds suspended therefrom.

12 Claims, 9 Drawing Sheets

(58) Field of Classification Search
USPC ..... 89/33.14, 33.2
See application file for complete search history.

(56) References Cited

U.S. PATENT DOCUMENTS 2,464,689 A * 3/1949 Jackson ..... F41A 9/86
89/33.14
2,494,564 A * 1/1950 Lambert ..... F41A 9/86
89/33.14
2,979,992 A * 4/1961 Colby ..... F41A 9/32
89/33.2
3,331,281 A * 7/1967 Jafvert ..... F41A 9/07
89/33.04
4,137,820 A * 2/1979 Clemens ..... F41A 9/86
89/33.14
4,191,088 A * 3/1980 Gardiner ..... F41A 9/32
89/33.2
4,292,878 A * 10/1981 Brooks ..... F41A 9/86
89/33.14
4,433,609 A * 2/1984 Darnall ..... F41A 9/79
89/34
4,484,404 A * 11/1984 Johnson ..... F41A 9/63
42/18
4,898,070 A * 2/1990 Kramer ..... F41A 9/86
89/34
5,020,414 A * 6/1991 Cook ..... F41A 9/86
89/34
8,763,511 B2 * 7/2014 Schvartz ..... F41A 9/34
89/33.14
2011/0081845 A1 * 4/2011 Dremel ..... B23F 21/005
451/259
2014/0311325 A1 * 10/2014 Schvartz ..... F41A 9/34
89/33.14
2016/0025435 A1 * 1/2016 Lung ..... F41A 9/57
89/37.15
2016/0025441 A1 * 1/2016 Lung ..... F41A 27/18
74/670
2018/0299215 A1 * 10/2018 Lung ..... F41A 9/86

FOREIGN PATENT DOCUMENTS

WO WO-2016064783 A1 * 4/2016 ..... F41A 9/30
WO WO-2017080800 A1 * 5/2017 ..... F41A 9/30

* cited by examiner

LOADING MECHANISM FOR SUSPENDED LOOP AMMUNITION

FIELD OF THE DISCLOSURE

The present disclosure relates to ammunition magazines in which linked rounds of ammunition are stowed in suspended loops each depending from an uppermost round supported by a pair of laterally spaced rails near the top of the magazine.

BACKGROUND OF THE INVENTION

Overhead ammunition magazines within armored vehicles for carrying linked ammunition are typically very difficult to load by hand. An operator must create a loop by hand and then guide the loop onto an overhead support rail near the top of the magazine, often in a blind fashion and/or while lifting considerable weight. An experienced operator typically supports some of the weight of the source belt of linked ammunition over his/her shoulder while the other hand is used to lift the loop and slide the ammunition into place. Operator error is frequent, the loading operation is difficult on the operator's fingers, and the lifted weight often exceeds the 95th percentile overhead lifting limit for human factors.

SUMMARY OF THE DISCLOSURE

A mechanism for loading suspended loops of linked ammunition onto rails of an ammunition magazine may generally comprise a guideway, a carriage guided by the guideway, and an anti-backdrive device.

The guideway may include inner cam surfaces and outer cam slots each extending vertically from a lower portion of the guideway and curving near an upper portion of the guideway toward a loading end of the magazine. The carriage may include a support block slidably received by the guideway and a tandem bucket mounted on the support block by a linkage. The tandem bucket may include a pair of cradles for respectively receiving two adjacent ammunition rounds, and inner and outer followers respectively engaging the cam surfaces and cam slots. The tandem bucket is maintained in a horizontal orientation and may be loaded with two adjacent rounds of a belt of linked ammunition when the carriage is at a lowered position. The carriage may then be raised manually, wherein the tandem bucket is articulated by camming engagement of the inner and outer followers to a vertical orientation to deposit one of the two rounds onto the magazine rails with the other round and trailing rounds suspended therefrom.

The anti-backdrive device may be configured in the manner of a one-way gate or turnstile to prevent the deposited rounds from returning with the carriage back to the lowered position.

The loading mechanism may be configured as a separate unit removably attachable to an ammunition magazine, or may be permanently fixed to or made integral with the ammunition magazine.

The loading mechanism of the present disclosure facilitates the task of loading an overhead ammunition magazine with suspended loops of linked ammunition. The loops may be created by the operator in a comfortable position and installed onto the rails of the ammunition magazine with ease, thereby reducing loading errors and operator injuries.

BRIEF DESCRIPTION OF THE DRAWING VIEWS

The nature and mode of operation of the present invention will now be more fully described in the following detailed description taken with the accompanying drawing figures, in which.

DETAILED DESCRIPTION

Figure 1:
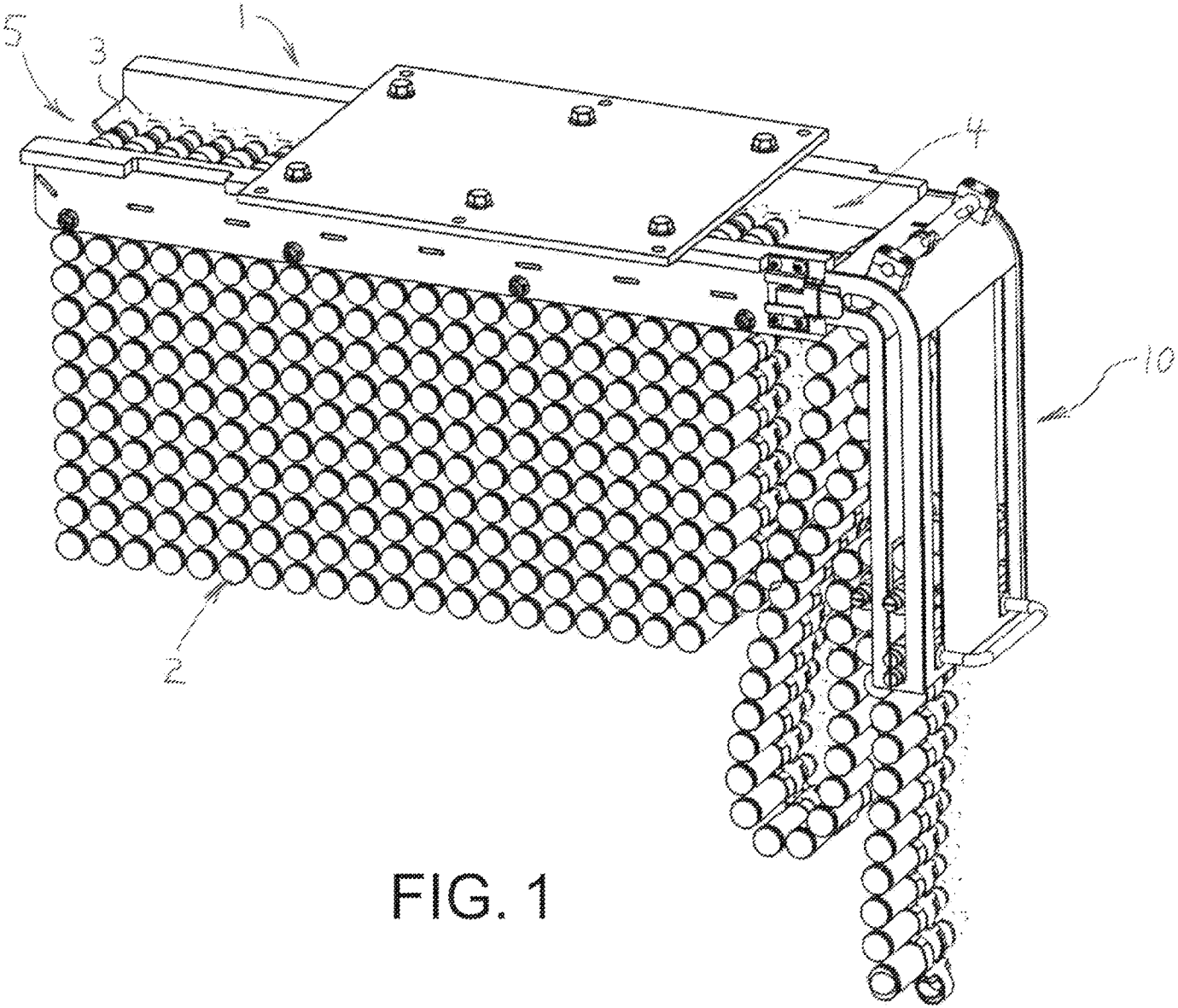
FIG. 1 is a perspective view of an ammunition magazine loaded with ammunition and equipped with a loading mechanism formed in accordance with an embodiment of the present disclosure.
Figure 2:
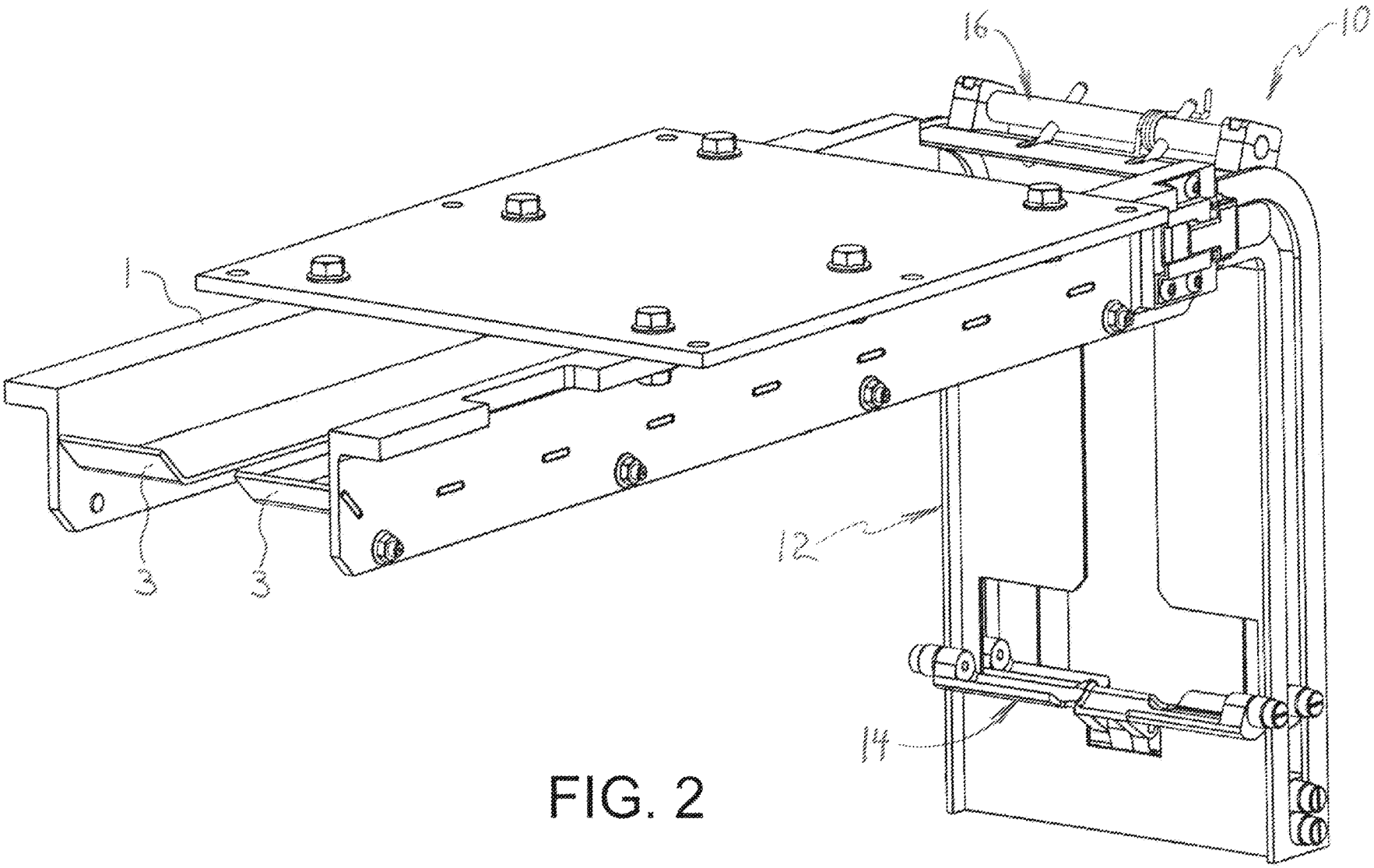
FIG. 2 is another perspective view of the ammunition magazine and loading mechanism shown in FIG. 1, wherein the ammunition magazine is empty of ammunition.
Figure 3:
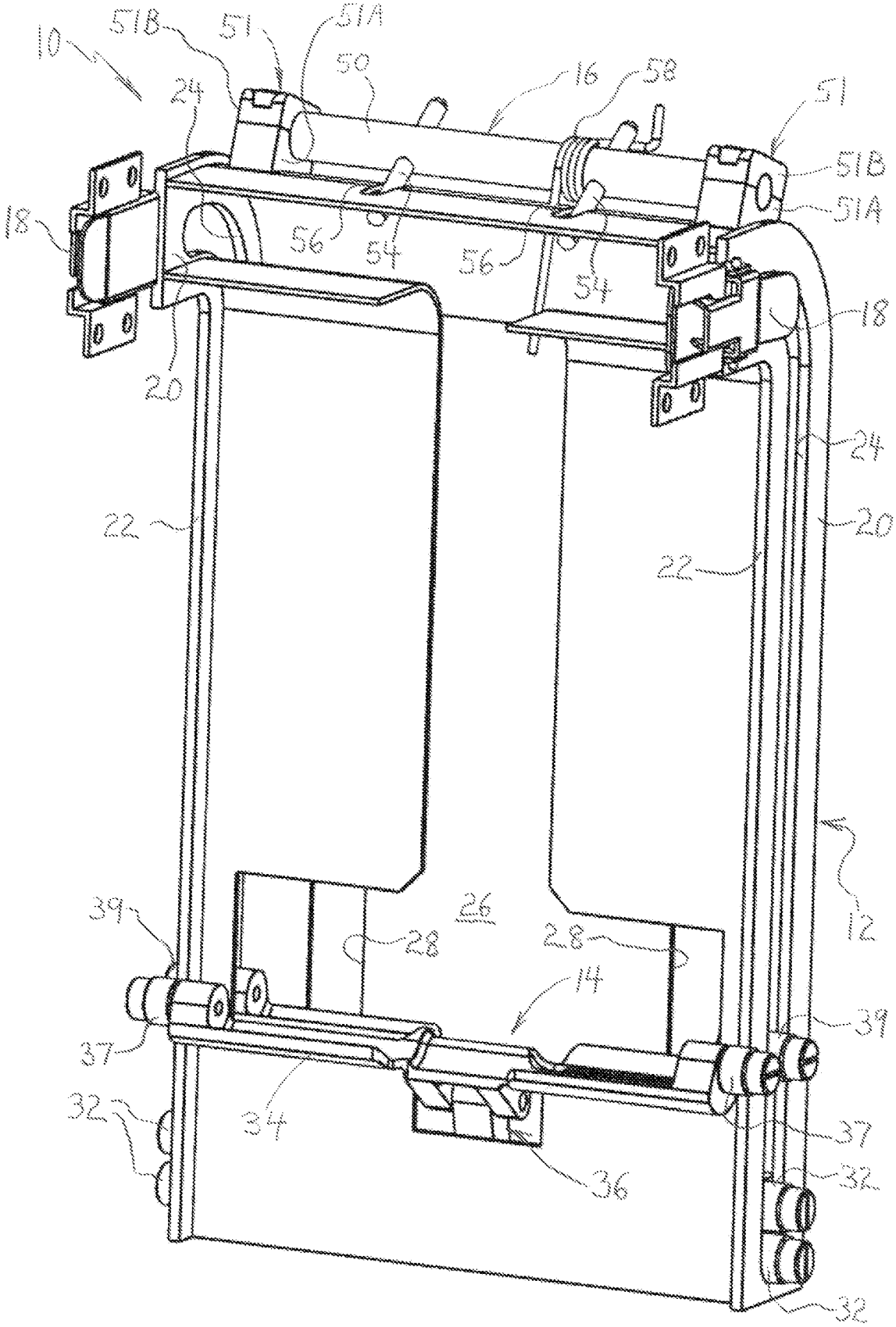
FIG. 3 is a perspective view of the loading mechanism in isolation, wherein a carriage of the loading mechanism is shown in a lowered position.
Figure 4:
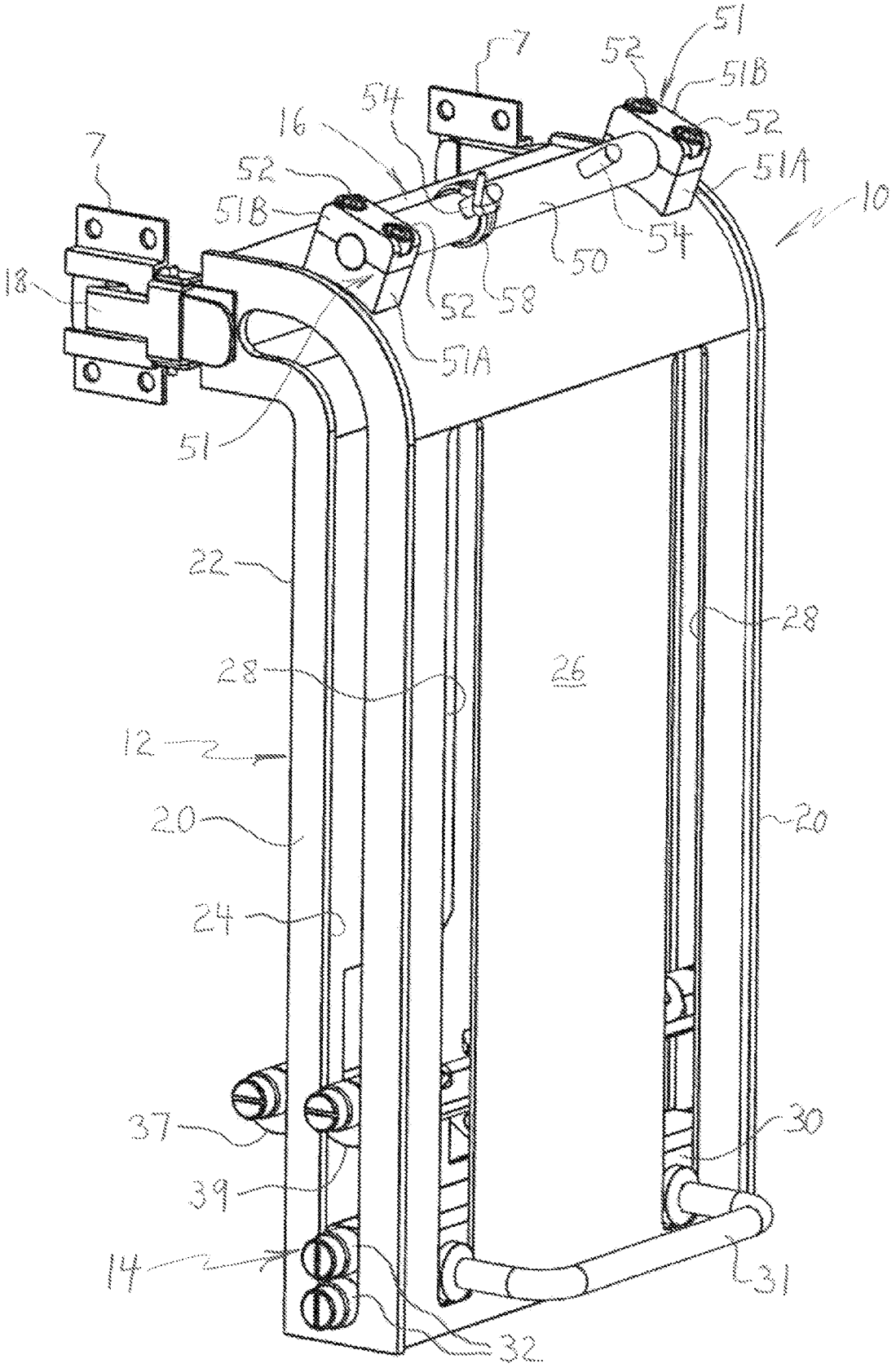
FIG. 4 is another perspective view of the loading mechanism in isolation, wherein the carriage of the loading mechanism is shown in the lowered position.

FIGS. 1 and 2 show an ammunition magazine 1 for holding a belt of linked ammunition 2 in a serpentine arrangement of loops suspended from a pair of spaced-apart rails 3 provided at an upper portion of the ammunition magazine. As will be appreciated, each loop depends from an uppermost round of ammunition supported at opposite ends by spaced rails 3. Ammunition magazine 1 is shown equipped with a loading mechanism 10 formed in accordance with an embodiment of the present disclosure. Loading mechanism 10 may be used by an operator to facilitate the task of loading rounds of linked ammunition 2 in magazine 1. More specifically, loading mechanism 10 may be used by an operator to lift and create precise loops of ammunition and slide the loops onto the laterally spaced rails 3. Loading mechanism 10 may be arranged at a loading end 4 of magazine 1 opposite a dispensing end 5 of magazine 1 from which the belt of ammunition is progressively dispensed as rounds are fired.

Figure 5:
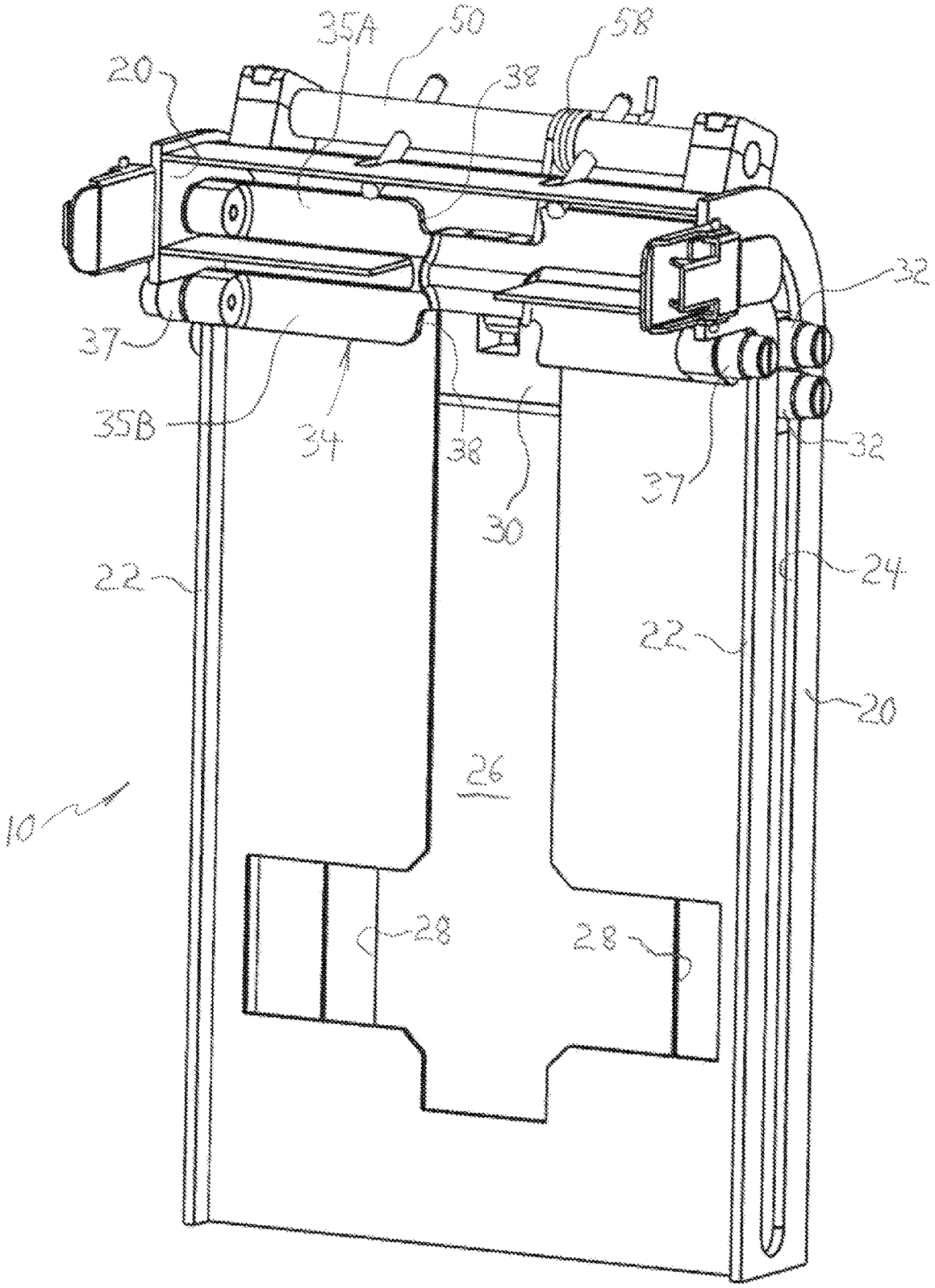
FIG. 5 is a view similar to that of FIG. 3, wherein the carriage is shown in a raised position.
Figure 6:
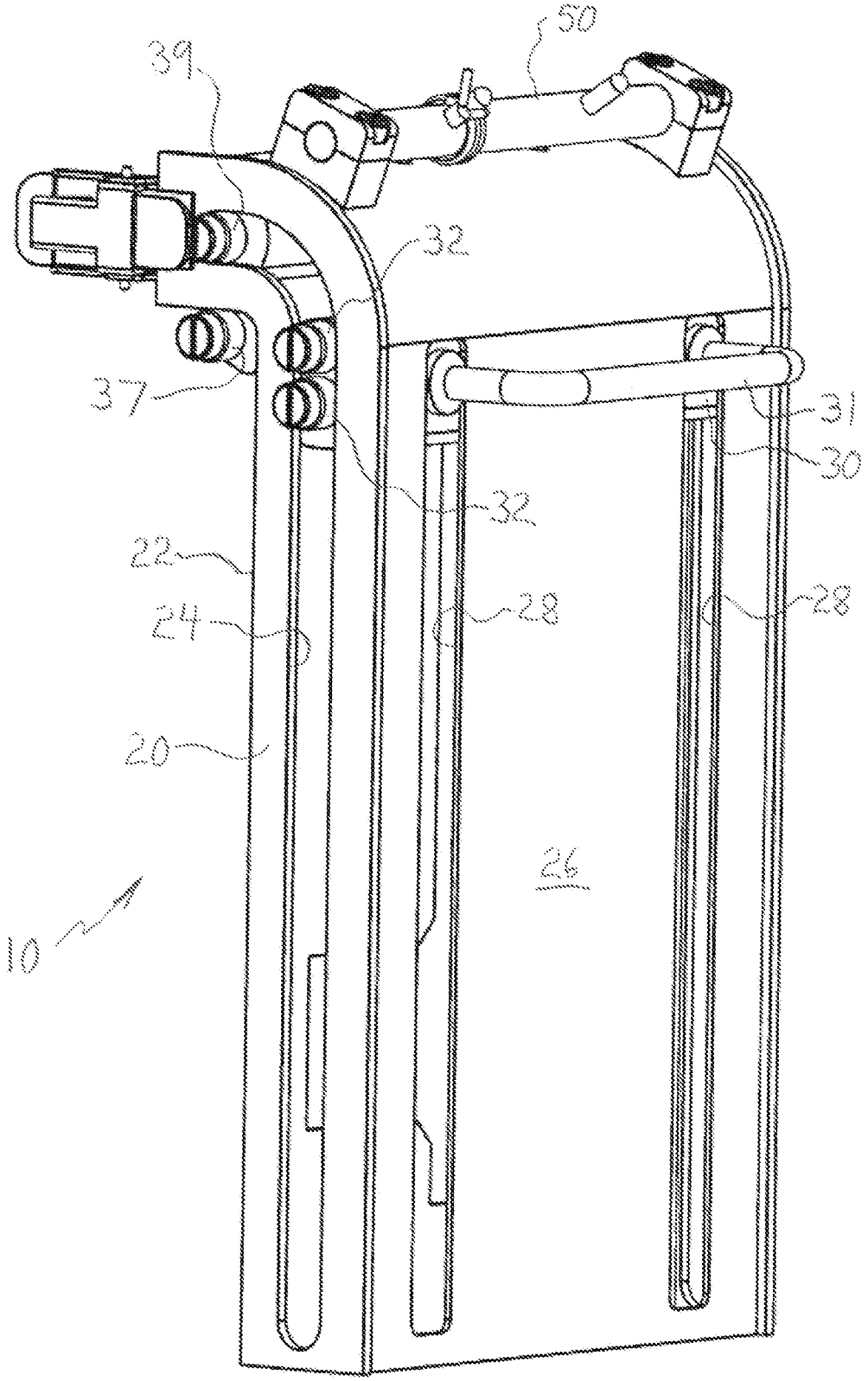
FIG. 6 is a view similar to that of FIG. 4, wherein the carriage is shown in the raised position.

Reference is also made now to FIGS. 3-6. Loading mechanism 10 may generally comprise a guideway 12 and a carriage 14 movable along guideway 12 between a lowered position (FIGS. 3 and 4) and a raised position (FIGS. 5 and 6). Loading mechanism 10 may further comprise an anti-backdrive device 16 at its upper end.

Guideway 12 may include a pair of parallel sidewalls 20 each having an inner cam surface 22 and an outer cam slot 24. Cam surface 22 and cam slot 24 may extend vertically from a lower portion of guideway 12 and curve near an upper portion of guideway 12 to extend horizontally a relatively short distance toward rails 3 at the loading end 4 of ammunition magazine 1. Sidewalls 20 may be connected by a faceplate 26 which may have a pair of vertical travel slots 28.

Carriage 14 may include a support block 30 slidably received between the sidewalls 20 of guideway 12, and a handle 31 fixed to support block 30 and arranged to extend through travel slots 28 and outward from faceplate 26 for access by an operator. Support block 30 may be guided for vertical displacement by two pairs of guide rollers 32 arranged on opposite sides of support block 30 such that each pair of guide rollers 32 is received by a respective one of the cam slots 24 in sidewalls 20. As may be understood, support block 30 is manually movable in upward and downward directions relative to guideway 12, but is prevented from pivoting or swinging about a transverse axis by the use of two guide rollers 32 instead of one on each lateral side. Carriage 14 may further include a tandem bucket 34 configured to support two adjacent rounds of ammunition, and a linkage 36 pivotally connected to support block 30 and tandem bucket 34 to permit tandem bucket 34 to translate and pivot relative to support block 30 as described in greater detail below. Tandem bucket 34 may include a pair of inner followers 37 arranged at opposite sides thereof to respectively engage inner cam surfaces 22, and a pair of outer followers 39 arranged at opposite sides thereof and respectively received by outer cam slots 24. Tandem bucket 34 may include two cradles 35A and 35B each sized and configured to receive and support a predetermined type of ammunition round, wherein each cradle 35A, 35B is bifurcated by a central gap 38 through which the belt assembly linking the rounds may pass. Inner followers 37 may be associated with cradle 35B, and outer followers 39 may be associated with cradle 35A.

Figure 7:
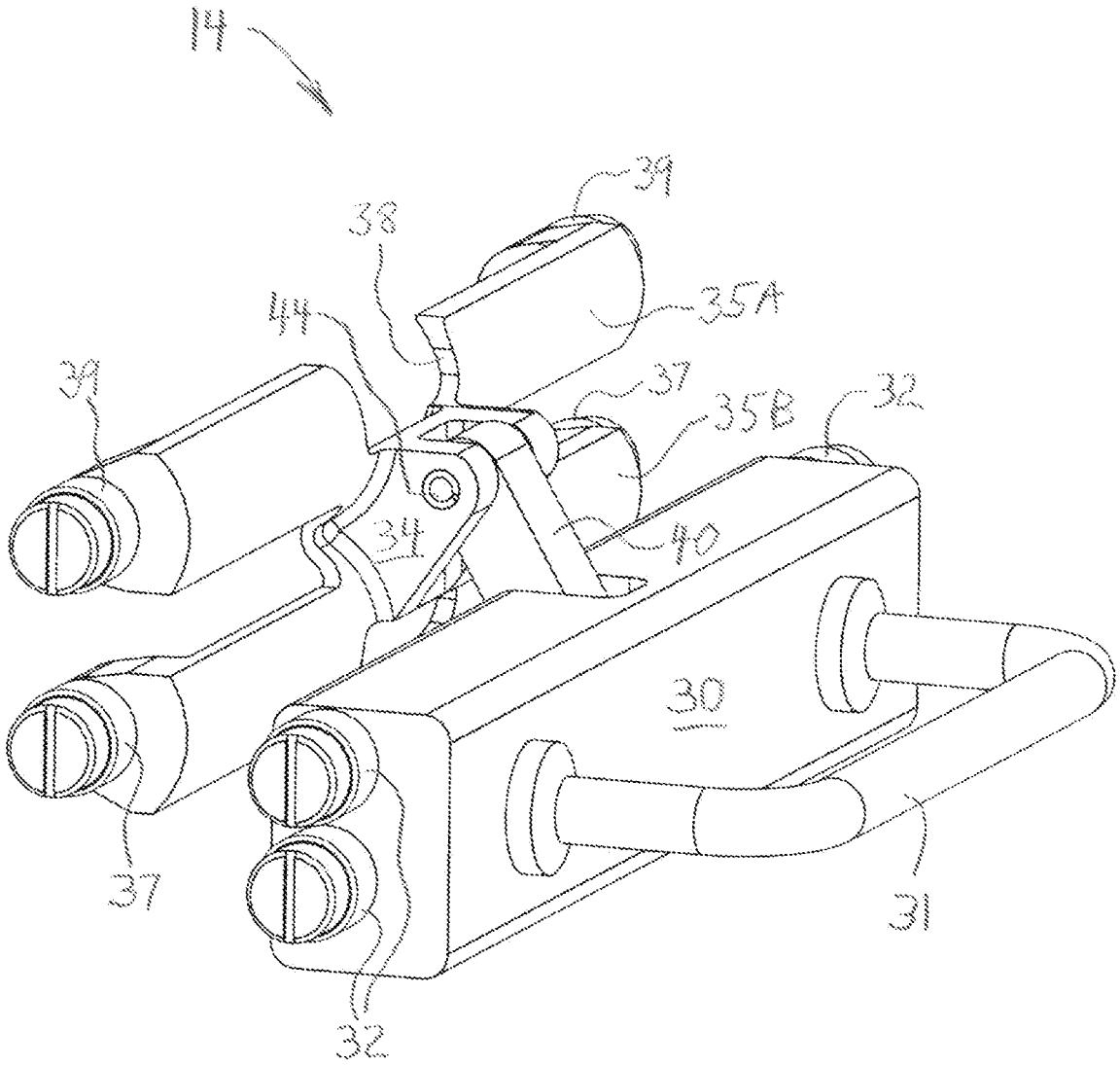
FIG. 7 is a perspective view of the carriage of the loading mechanism in isolation.
Figure 8A:
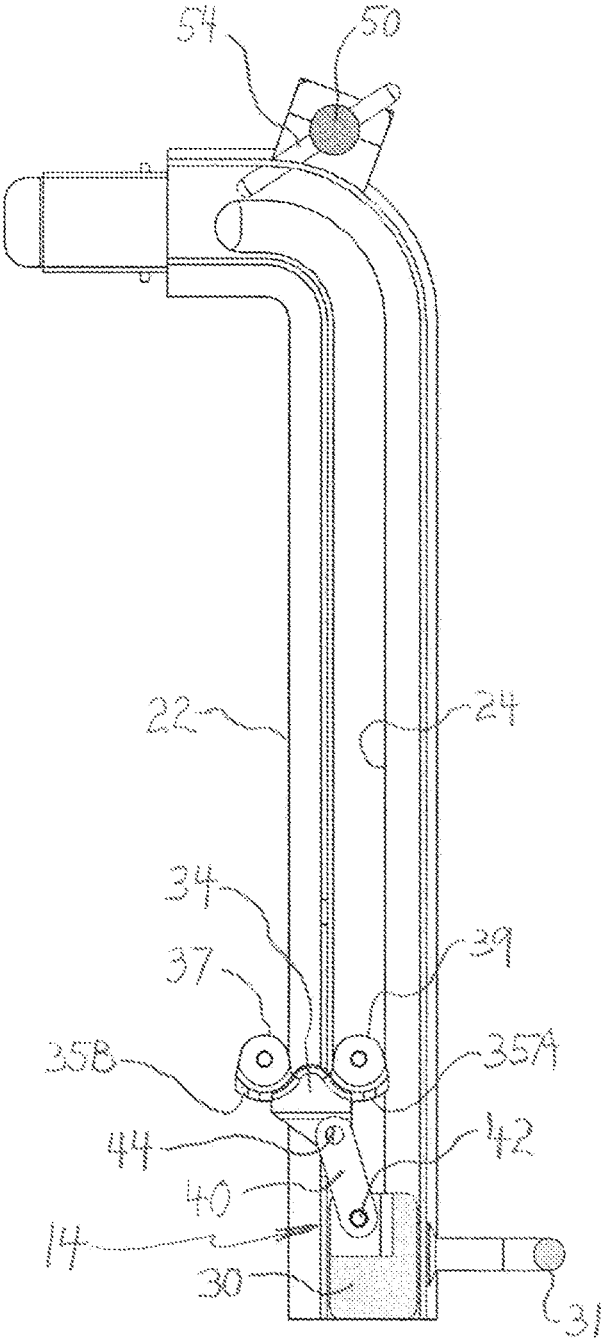
FIG. 8A is a cross-sectional view of the loading mechanism wherein the carriage is shown in the lowered position.
Figure 8B:
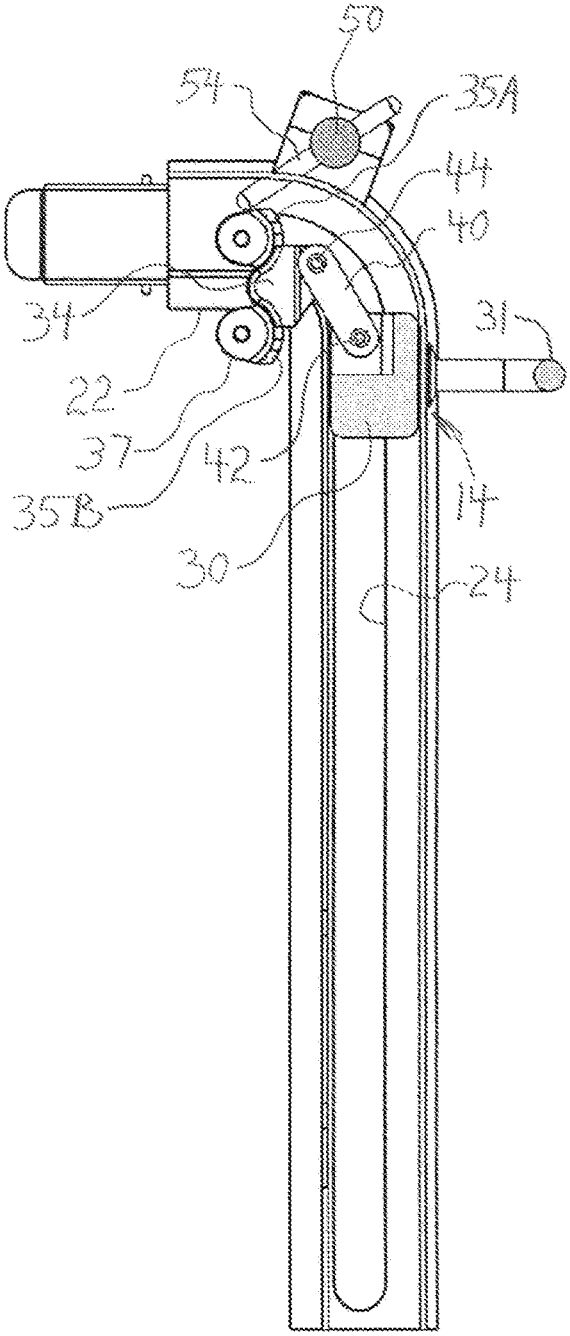
FIG. 8B is a cross-sectional view of the loading mechanism wherein the carriage is shown in the raised position.

As best seen in FIGS. 7, 8A, and 8B, linkage 36 of carriage 14 may include a straight link 40 having a first end pivotally coupled to support block 30 by a pivot pin 42 to enable link 40 to pivot relative to support block 30 about a laterally extending axis of pin 42, and a second end pivotally coupled to tandem bucket 34 by a pivot pin 44 to enable tandem bucket 34 to pivot relative to link 40 about a laterally extending axis of pin 44. Pivot pins 42 and 44 may be embodied as spring pins or cylindrical pins. When carriage 14 is moved to the lowered position shown in FIG. 8A, engagement of inner followers 37 with inner cam surface 22 and engagement of outer followers 39 with a boundary surface of cam slot 24 positions tandem bucket 34 and linkage 36 such that cradles 35A and 35B are horizontally adjacent one another. When carriage 14 is moved to the raised position shown in FIG. 8B, engagement of inner followers 37 with inner cam surface 22 and engagement of outer followers 39 with a boundary surface of cam slot 24 positions tandem bucket 34 and linkage 36 such that cradles 35A and 35B are vertically adjacent one another.

Anti-backdrive device 16 may include a transverse axle 50 rotatably journalled by rotational supports 51 mounted atop guideway 12 to permit the axle to rotate about its axis relative to the guideway. For example, each rotational support 51 may include a base portion 51A and a top portion 51B secured to the base portion by fasteners 52, wherein base portion 51A and top portion 51B each include a semi-cylindrical cutout for receiving a radially reduced end portion of axle 50. Axle 50 may carry one or more gate members 54 extending radially from the axle, each gate member having a distal end received through a corresponding slot 56 in guideway 12. Axle 50 and each gate member 54 may rotate about the axis of axle 50 between a blocking position and a passage position with respect to a round of ammunition carried in cradle 35A. Axle 50 may be biased by a torsion spring 58 urging the axle in a counterclockwise angular direction as viewed in FIGS. 8A and 8B toward its blocking position, and each gate member 54 may be angled to be pushed and rotated against the bias of torsion spring 58 toward its passage position when engaged by a round of ammunition in cradle 35A as carriage 14 is moved from its lowered position to its raised position. Cradle 35A, however, cannot pass completely under gate members 54. Once the round of ammunition in cradle 35A passes under gate member 54, axle 50 and gate members 54 rotate in a reverse direction under the power of torsion spring 58. Consequently, a round of ammunition carried in cradle 35A will be prevented by gate members 54 from returning through anti-backdrive device 16 with carriage 14 is returned from its raised portion to its lowered position. In this manner, anti-backdrive device 16 functions as a one-way turnstile through which ammunition rounds may be received onto rails 3 at loading end 4 of magazine 1. Of course, the function performed by anti-backdrive device 16 may be achieved by mechanisms differing from that shown in the figures and described above.

Loading mechanism 10 may comprise a pair of latches 18 configured for releasable mating with a pair of latch receptacles 7 provided at loading end 4 of ammunition magazine 1, whereby loading mechanism 10 may be removably attached to magazine 1. Other releasable fastening devices, for example threaded fasteners, may be used in place of latches. Alternatively, loading mechanism 10 may be permanently fixed to ammunition magazine 1, or loading mechanism 10 may be incorporated as an integral non-removable feature of ammunition magazine 1 by forming inner cam surfaces 22 and outer cam slots 24 directly into an existing ammunition box structure for similar performance.

Figure 9:
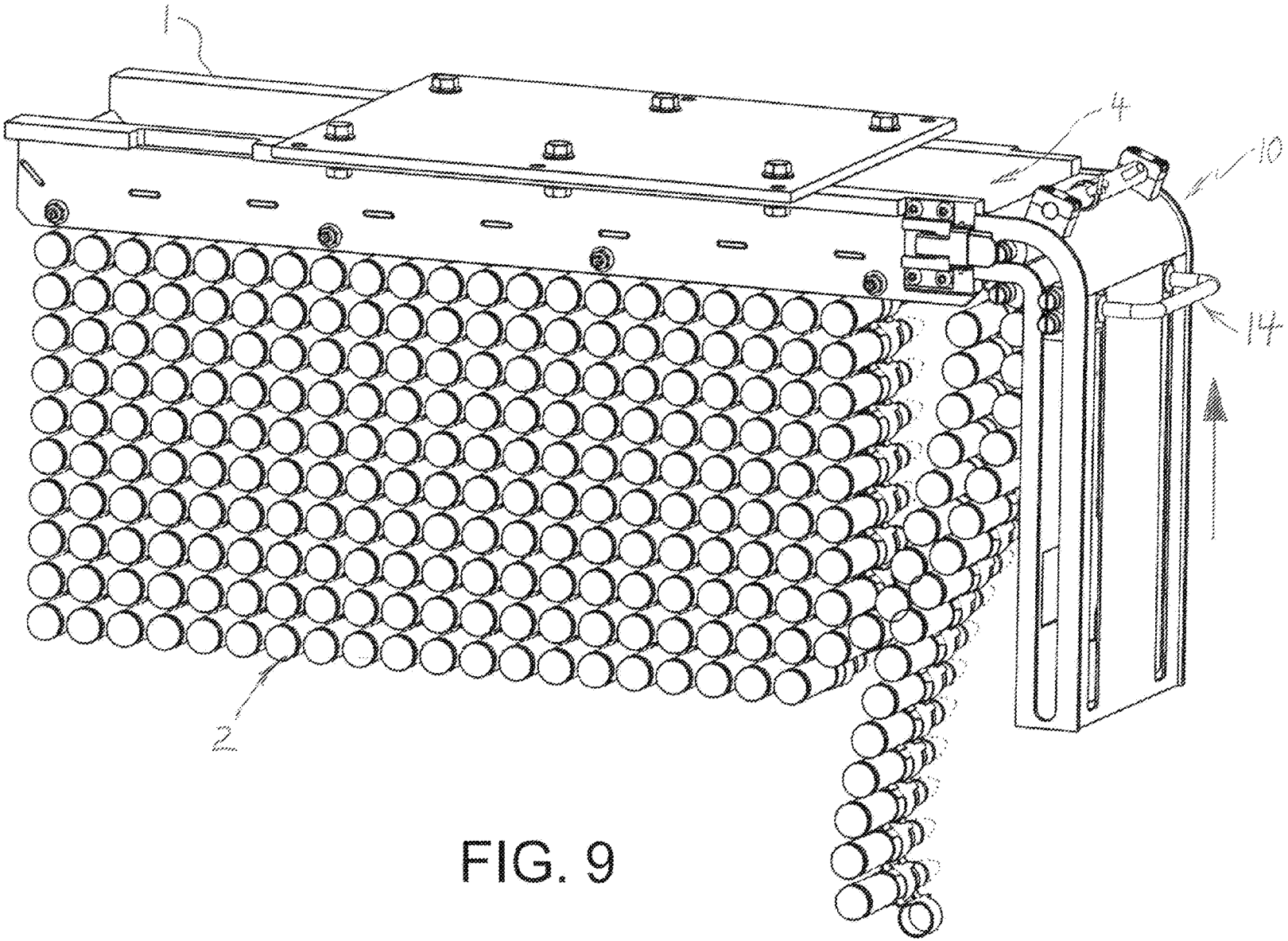
FIG. 9 is a view similar to that of FIG. 1, wherein the carriage of the loading mechanism is shown in its raised position depositing rounds of ammunition onto rails of the ammunition magazine.

An operator uses loading mechanism 10 by inserting two adjacent rounds of ammunition into cradles 35A, 35B when carriage 14 is at its lowered position, as shown in FIG. 1, and then manually moving carriage 14 from its lowered position to its raised position as depicted in FIG. 9. When carriage 14 reaches its raised position, the round of ammunition carried by 35A will be delivered onto support rails 3 of ammunition magazine 1, and the round of ammunition carried by cradle 35B, along with subsequent trailing rounds linked thereto, will be suspended from the supported round as the belt linking the rounds of ammunition passes through the lateral space between rails 3. The process may be repeated to suspend additional loops to reload ammunition magazine 1.

In the depicted embodiment, handle 31 is provided on support block 30 for manual operation. Additionally or alternatively, a cable having a pull handle may be connected to support block 30 and routed over a pulley to enable an operator to raise carriage 14 by pulling downward on the pull handle, thereby allowing the operator to use his or her body weight for advantage.

As may be understood, loading mechanism 10 may be scaled and dimensioned depending on the type of linked ammunition.

The loading mechanism of the present disclosure greatly assists an operator in the task of loading an overhead ammunition magazine with suspended loops of linked ammunition. The loops may be created by the operator in a comfortable position and installed onto the rails of the ammunition magazine with ease. Consequently, loading errors and operator injuries are reduced.

While the disclosure describes exemplary embodiments, the detailed description is not intended to limit the scope of the invention to the particular forms set forth. The invention is intended to cover such alternatives, modifications and equivalents of the described embodiments as may be apparent to one of ordinary skill in the art.

What is claimed is:

1. A loading mechanism for loading a belt of linked ammunition into a magazine having a pair of spaced-apart rails, the loading mechanism comprising:

a guideway; and a carriage movable along the guideway between a lowered position and a raised position, the carriage including an articulated tandem bucket having a pair of cradles arranged to support two adjacent rounds of the belt of linked ammunition;

wherein the tandem bucket is engaged by the guideway such that the pair of cradles are in a horizontal orientation when the carriage is in the lowered position and the pair of cradles are in a vertical orientation when the carriage is in the raised position.

2. The loading mechanism of claim 1, wherein the guideway includes a cam surface and a cam slot each extending vertically from a lower portion of the guideway and curving near an upper portion of the guideway toward the rails at a loading end of the magazine.

3. The loading mechanism of claim 2, wherein the carriage comprises a support block slidably received by the guideway, the tandem bucket is mounted on the support block by a linkage, and the tandem bucket includes an inner follower engaging the cam surface of the guideway and an outer follower engaging the cam slot of the guideway.

4. The loading mechanism of claim 3, wherein the carriage further comprises a handle fixed to the support block, such that the carriage is manually movable via the handle.

5. The loading mechanism of claim 3, wherein the carriage further comprises a pair of guide rollers arranged on the support block and received by the cam slot of the guideway, such that vertical displacement of the support block is guided by the pair of guide rollers.

6. The loading mechanism of claim 1, wherein each of the cradles is bifurcated by a central gap through which the belt of linked ammunition is passed.

7. The loading mechanism of claim 1, further comprising an anti-backdrive device arranged to prevent the two adjacent rounds from returning with the carriage from the raised position back to the lowered position.

8. The loading mechanism according to claim 7, wherein the anti-backdrive device comprises:

an axle mounted to rotate about a transverse axis relative to the guideway;

a gate member extending radially from the axle, wherein the axle and the gate member rotate about the transverse axis between a blocking position and a passage position; and a torsion spring which urges the axle toward the blocking position;

wherein the gate member is rotatable against the bias of the torsion spring to the passage position when the gate member is engaged by one round of the two adjacent rounds as the carriage is moved from the lowered position to the raised position such that the one round passes through the anti-backdrive device for deposit onto the pair of spaced apart rails, and wherein the gate member returns to the blocking position with the bias of the torsion spring as the carriage is moved from the raised position toward the lowered position such that the one round is blocked from a return passage through the anti-backdrive device.

9. The loading mechanism of claim 1, further comprising a latch which releasably mates with a latch receptacle provided at a loading end of the magazine.

10. A method of loading a belt of linked ammunition into a magazine having a pair of spaced-apart rails, the method comprising:

A) providing a loading mechanism comprising:

a guideway; and a carriage movable along the guideway between a lowered position and a raised position, the carriage including an articulated tandem bucket having a pair of cradles arranged to support two adjacent rounds of the belt of linked ammunition;

B) loading two adjacent rounds of ammunition into the pair of cradles when the carriage is in the lowered position; and C) moving the carriage from the lowered position to the raised position to deposit one round of the two adjacent rounds of the belt of linked ammunition onto the pair of spaced-apart rails with the other round and trailing rounds suspended from the one round.

11. The method of claim 10, wherein the tandem bucket is engaged by the guideway such that the pair of cradles pivot from a relatively horizontal orientation to a relatively vertical orientation as the carriage approaches the raised position.

12. The method of claim 10, further comprising:

D) moving the carriage from the raised position to the lowered position; and

E) repeating steps B through D to load additional rounds of the belt of linked ammunition into the magazine.

* * * * *